US006862358B1

(12) United States Patent
Tabata

(10) Patent No.: US 6,862,358 B1
(45) Date of Patent: Mar. 1, 2005

(54) PIEZO-FILM SPEAKER AND SPEAKER BUILT-IN HELMET USING THE SAME

(75) Inventor: Hajime Tabata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 470 days.

(21) Appl. No.: 09/680,429

(22) Filed: Oct. 6, 2000

(30) Foreign Application Priority Data

Oct. 8, 1999 (JP) ..... 11-288148

(51) Int. Cl.[7] ..... H04R 25/00

(52) U.S. Cl. ..... 381/301; 381/333; 381/336; 381/190

(58) Field of Search ..... 381/152, 182, 381/190, 191, 301, 333, 334, 335, 336, 338, 173, 322, 364, 367, 370, 371, 376, 430; 2/69, 905, 209, 900; 310/328, 330, 311, 320, 322, 324

(56) References Cited

U.S. PATENT DOCUMENTS 4,440,983 A * 4/1984 Facoetti et al. ..... 381/190
4,578,613 A * 3/1986 Posthuma de Boer et al. ... 381/190
5,283,835 A 2/1994 Athanas
5,309,519 A * 5/1994 Park et al. ..... 381/190
5,684,884 A 11/1997 Nakaya et al.
5,736,808 A * 4/1998 Szilagyi et al. ..... 310/322
6,396,197 B1 * 5/2002 Szilagyi et al. ..... 310/330

FOREIGN PATENT DOCUMENTS

JP U6344584 3/1988
JP A63175106 7/1988
JP A7327298 12/1995

OTHER PUBLICATIONS

"Piezo Film Sensors, Technical Manual". Measurement Specialities, Inc. Apr. 2, 1999.*
Piezo Film Sensors, Technical Manual.*

* cited by examiner

*Primary Examiner*—Suhan Ni
(74) *Attorney, Agent, or Firm*—Birch, Stewart, Kolasch & Birch, LLP

(57) ABSTRACT

A flat piezo-film speaker is mounted in a motorcycle helmet. The flat-piezo film speaker is formed from a flat piezo-film curved in one direction to form at least one curved portion. A radius R of curvature at the curved portion is larger than at least 200 mm, preferably, in a range of 210 mm≦R≦360 mm. The piezo-film speaker built into a helmet for a motorcycle rider is capable of reproducing sound at a sound pressure sufficiently audible even when running the motorcycle and at a high tone quality.

8 Claims, 4 Drawing Sheets

Fig. 1
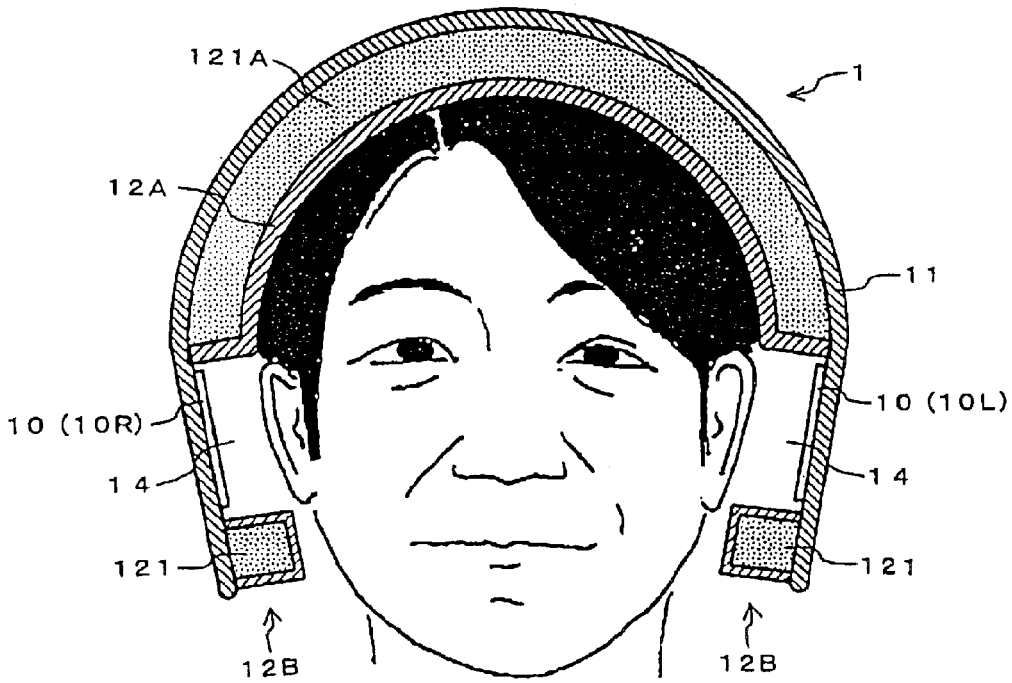
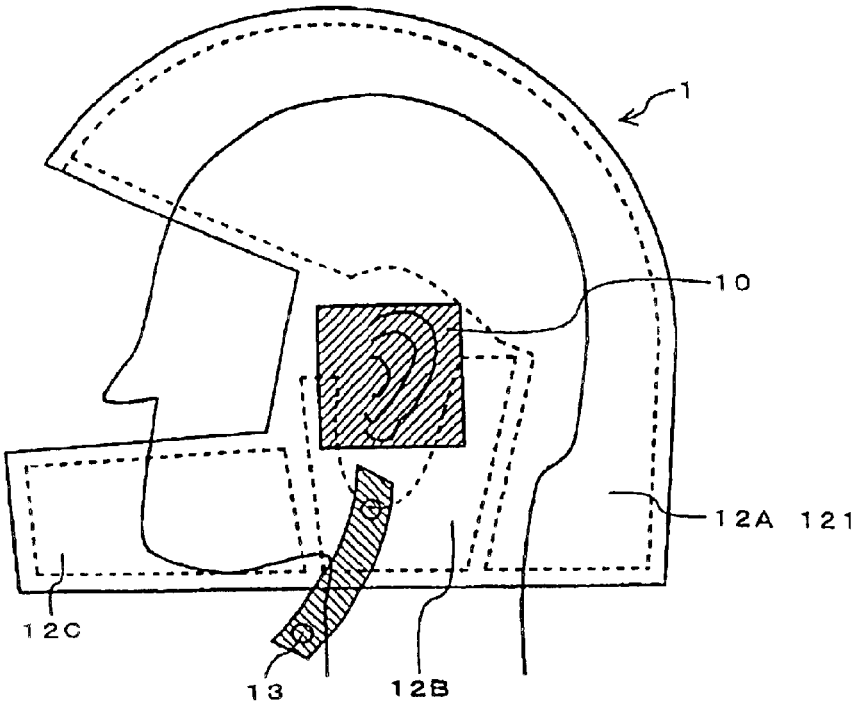
Fig. 2

PIEZO-FILM SPEAKER AND SPEAKER BUILT-IN HELMET USING THE SAME

BACKGROUND OF THE INVENTION

1. Field of the Invention

The present invention relates to a piezo-film speaker and a helmet using the piezo-film speaker, and particularly to a piezo-film speaker capable of efficiently reproducing sound at a high tone quality within a motorcycle helmet requiring a built-in speaker and using the piezo-film speaker.

2. Background Art

Magnet (or voice coil) speakers of a type including a voice coil provided on a truncated cone have been widely used as speakers built into helmets, such as motorcycle helmets. However, magnet speakers according to the background art have limitations in both their failure to permit adequate miniaturization and lightweightness.

One solution is the adoption of a piezo-film speaker within a space of a helmet for improving a rider's comfort when the helmet is put on and worn by the rider. This type of speaker has been disclosed, for example, in Japanese Patent Laid-open No. Sho 63-175106 and the microfilm of Japanese Utility Model Laid-open No. Sho 63-44584.

The above piezo-film speaker, however, suffers from a major shortcoming. Specifically, a flat-plate like piezoelectric material is used as a diaphragm with the above-mentioned piezo-film speaker and as a result, the output (sound pressure) is generally low.

Similarly, Japanese Patent Laid-open No. Hei 7-327298 has disclosed a curved piezo-film speaker characterized in that a higher output efficiency is obtained as a radius of curvature at the curved portion of the speaker becomes smaller.

However, the above-described prior art piezo-film speaker has disclosed only a general technique for increasing the output of the piezo-film speaker, and have ignored tone quality with respect to said speakers. Tone quality is particularly important when the piezo-film speaker is used as a sound speaker and a sound pressure most suitable when it is used for a helmet for a motorcycle rider.

For example, as described in the above document, Japanese Patent Laid-open No. Hei 7-327298, the output of the piezo-film speaker becomes higher as the radius of curvature becomes smaller; however, since the peak of the output characteristic is shifted on a higher frequency side from an audio frequency band, a high tone quality cannot be obtained, particularly, when used for voice or audio reproduction.

SUMMARY OF THE INVENTION

The present invention overcomes the shortcomings associated with the prior art and achieves other advantages not realized by the prior art.

An object of the present invention is to solve the above-described problems of the prior art piezo-film speakers and to provide a piezo-film speaker built into a helmet for a motorcycle rider, which is capable of reproducing sound at a sound pressure sufficiently audible, even when running/operating the motorcycle.

A further object of the present invention is to provide voice/sound reproduction at a sound pressure having a high tone quality and adequate volume.

To achieve the above object, the present invention provides a piezo-film speaker in which a flat piezo-film is curvedly supported, characterized in that the piezo-film speaker utilizes the following unique features in a variety of desirable arrangements:

(1) A radius R of curvature at the curved portion is set in a range of $R \geqq 200$ mm.

(2) A radius R of curvature at the curved portion is set in a range of 210 mm$\leqq R \leqq$360 mm.

(3) An area S of a principal surface of the piezo-film is in a range of $S \geqq 40$ cm$^2$.

(4) An area S of a principal surface of the piezo-film is in a range of 40 cm$^2 \leqq S \leqq 100$ cm$^2$.

According to the above feature (1), the frequency characteristic of a sound pressure in an audio frequency band can be flattened, and voice reproduction can be accomplished at a high tone quality.

According to the feature (2), the frequency characteristic of a sound pressure in an audio frequency band can be flattened, but the sound pressure level is also made relatively high, with the result that voice reproduction can be accomplished at a high tone quality and sufficient volume.

According to the feature (3), the frequency characteristic of a sound pressure in an audio frequency band can be flattened, but the sound pressure level is also made relatively high with the result that voice reproduction can be accomplished at a high tone quality and sufficient volume.

According to the feature (4), it is possible to accomplish voice reproduction at a high tone quality and sufficient volume while maintaining simplicity with respect to mounting requirements for the piezo-film speaker in a motorcycle helmet.

These and other objects are accomplished by a piezo-film speaker comprising a flat piezo-film curvedly supported to form at least one curved portion, said flat piezo-film having at least a radius (R) of curvature at each curved portion is in a range of $R \geqq 200$ mm or an area (S) of a principal surface of said piezo-film is in a range of $S \geqq 40$ cm$^2$.

These and other objects are accomplished by a motorcycle helmet including a hard, thin helmet shell, said helmet comprising a piezo-film speaker built into said helmet, wherein said piezo-film speaker includes a flat piezo-film curvedly supported to form at least one curved portion, said flat piezo-film having at least a radius (R) of curvature at each curved portion is in a range of $R \geqq 200$ mm or an area (S) of a principal surface of said piezo-film is in a range of $S \geqq 40$ cm$^2$.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a sectional view of a helmet in which a piezo-film speaker of the present invention is built-in;

FIG. 2 is a side view of the helmet shown in FIG. 1;

DETAILED DESCRIPTION OF THE PREFERRED EMBODIMENTS

Figure 3:
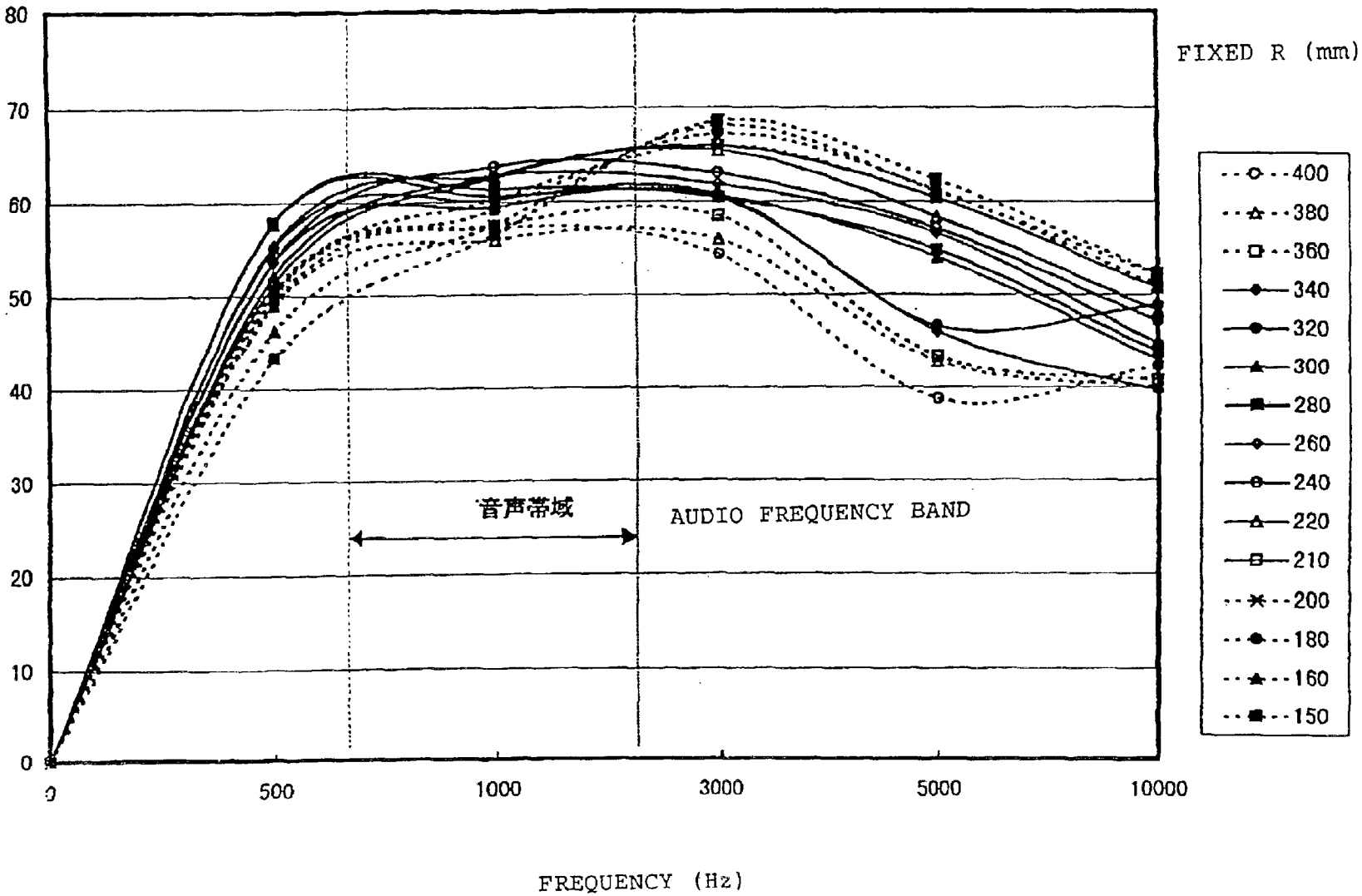
FIG. 3 is a graphical view showing frequency-sound pressure characteristics of the piezo-film speaker curvedly supported in a helmet, with a radius of curvature at a curved portion taken as a parameter.

Hereinafter, the present invention will be described in detail with reference to the accompanying drawings. FIG. 1 is a sectional view of a helmet in which a piezo-film speaker of the present invention is built-in. FIG. 2 is a side view of the helmet shown in FIG. 1.

A helmet 1 includes a hard, thin helmet shell 11 made typically from a fiber-reinforced plastic material. The shell 11 includes a liner (head liner) 121A made from expanded polystyrene in a preferred embodiment, which is fixed on the inner surface of the helmet shell 11, and a head inner 12A removably and dividedly mounted in such a manner as to cover the head liner 121A by means of a tape ("Magic Tape", trade name) or the like. Ear inners 12B and a chin inner 12C are also removably and dividedly mounted, together with liners 121, inside the helmet shell 11. A chin strap 13 is further provided and fixed to the helmet shell 11.

As shown in FIG. 2, the ear inner 12B and its liner are formed into an approximately U-shaped or ring-shaped structure with a space formed at a location matching the periphery of a rider's ear. This arrangement is intended to provide a structure that will not press against the rider's ear, but will still protect both the periphery of the rider's ear and a driver's temple when the helmet 1 is put on the driver's head. The head liner 121A and the ear inner 12A are each formed into shapes that will not interfere with the driver's ears.

Right and left speakers 10 (10R and 10L) used for the helmet 1 are removably mounted on the inner surfaces of portions of the helmet shell 11. The speakers 10 are exposed to spaces 14 formed between respective liners in order to avoid the contact of the liners with the rider's ears and secured by means of a fixing member such as a tape ("Magic Tape").

According to one embodiment, each speaker 10 is not fixed to an elastic interior material liable to be significantly deteriorated over time, such as the liner 121 (or inner). Instead, each speaker 10 is fixed on the harder surface of the helmet 1 which is less likely to deteriorate over time. Accordingly, the speaker 10 can be rigidly fixed to the helmet 1 while being stably kept in a desired position for maximum operational effectiveness.

Figure 4:
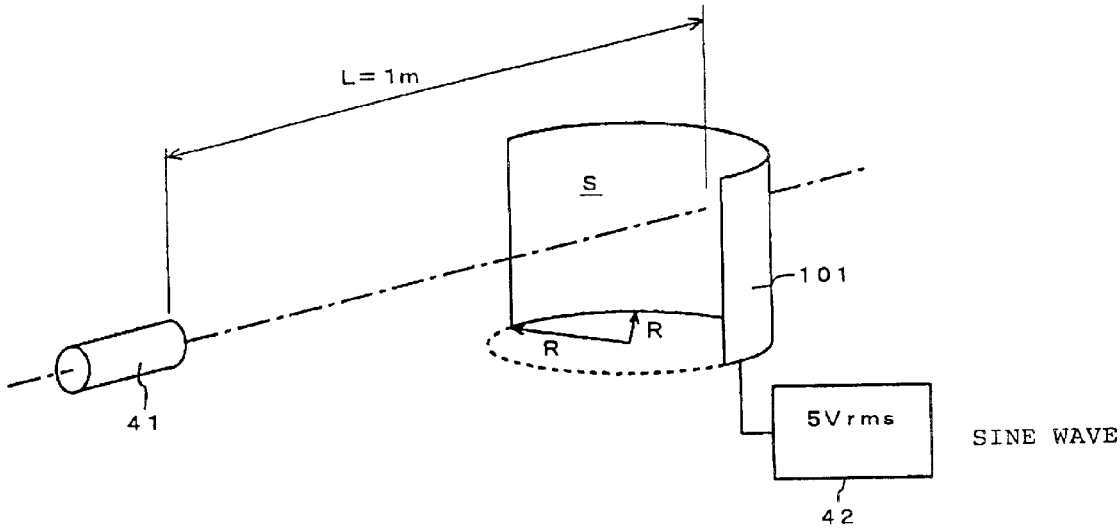
FIG. 4 is a perspective view showing a supported shape of the piezo-film speaker.

FIG. 3 is a graphical view showing a relationship between frequency (Hz) and sound pressure (dB) of the above-mentioned piezo-film speakers. In particular, a radius (R) of curvature at a curved portion of the piezo-film speaker 101 which is curved in one direction as shown in FIG. 4 is taken as a parameter. In addition, a sine wave of 5 Vrms is applied to the piezo-film speaker 101 from an oscillator 42, and a microphone 41 is separated from the piezo-film speaker 101 by a distance of 1 m.

FIG. 4 is a perspective view showing a supported shape of the piezo-film speaker.

However, FIG. 4 is not meant to suggest that the piezo-film speaker 101 is curved into an perfect circular arc. Instead, the radius (R) of curvature represents a substantial radius of curvature at each curved portion. The piezo-film speaker 101 has a film thickness "t" of 110 $\mu$m, an area S of 50 $cm^2$, and a rectangular shape of 100 mm×50 mm.

In FIG. 3, since the majority of information necessary for a rider using the helmet 1 is normally audio information, attention should be focused on a main audio frequency band ranging from 700 Hz to 2 KHz. The experimental results produced by the present inventors, as shown in FIG. 3, are as follows. Namely, in the case of a piezo-film speaker having a radius R of curvature which is in a range of 360 mm or more, or in a range of 200 mm or less (shown by broken lines), the sound pressure produced is lower than the sound pressure of a piezo-film speaker having the radius R of curvature which is in a range of 200 mm$\leqq$R$\leqq$360 mm (shown by solid lines). Furthermore, the present inventors have discovered that the frequency characteristics of the sound pressure in the audio frequency band is not flattened in the piezo-film speakers having a radius R of curvature within the desired range.

In addition, in the case of the piezo-film speaker having the radius R of curvature in the range of 200 mm or less the frequency characteristic of the sound pressure in the audio frequency band is not flattened. However, the sound pressure becomes lower as the frequency becomes lower, so that a high frequency portion of a voice signal is emphasized to deteriorate the tone quality. Further, in a low frequency side (near 700 Hz) of the audio frequency band, the sound pressure is lower than that in the other frequency side of the audio frequency band, so that the efficiency of output to input is reduced.

In summary, when the radius R of curvature of the piezo-film speaker curvedly-supported is in the range of 200 mm or less, both the tone quality and sound pressure of the piezo-film speaker are insufficient and undesirable. Accordingly, the radius R of curvature of the piezo-film speaker curvedly supported is required to be larger than at least 200 mm.

On the other hand, if the radius R of curvature is 360 mm or more, the balance in sound pressure in the audio frequency band is preferable. However, since the sound pressure is relatively low (value lower khan 60 dB estimated to be measured when the same sine wave is supplied to a magnet speaker), except for the case of the piezo-film speaker being used in an environment where voice is audible at a small sound pressure, problems occur in picking up the sound from the speaker effectively. Accordingly, in consideration of a speaker for a helmet put on a motorcycle rider, the upper range of the radius R of curvature is preferably limited to a range less than 360 mm.

In this way, when the radius R of curvature of the piezo-film speaker curvedly supported is outside of the desired range of 210$\leqq$R$\leqq$360 mm, a sufficient sound volume cannot be obtained in the entire audio frequency band, particularly when the radius R of curvature of the piezo-film speaker curvedly supported is 200 mm or less. Furthermore, when the radius R of curvature of the piezo-film speaker curvedly supported is 200 mm or less, the frequency characteristic of the sound pressure in the audio frequency band is not flattened and the sound quality becomes different from the original one.

Accordingly, the radius R of curvature of the piezo-film speaker curvedly supported may be desirable to be larger than at least 200 mm, and more desirable to be limited to a range of 210 mm$\leqq$R$\leqq$360 mm in order to reproduce voice at a high tone quality and a sufficient sound volume.

Figure 5:
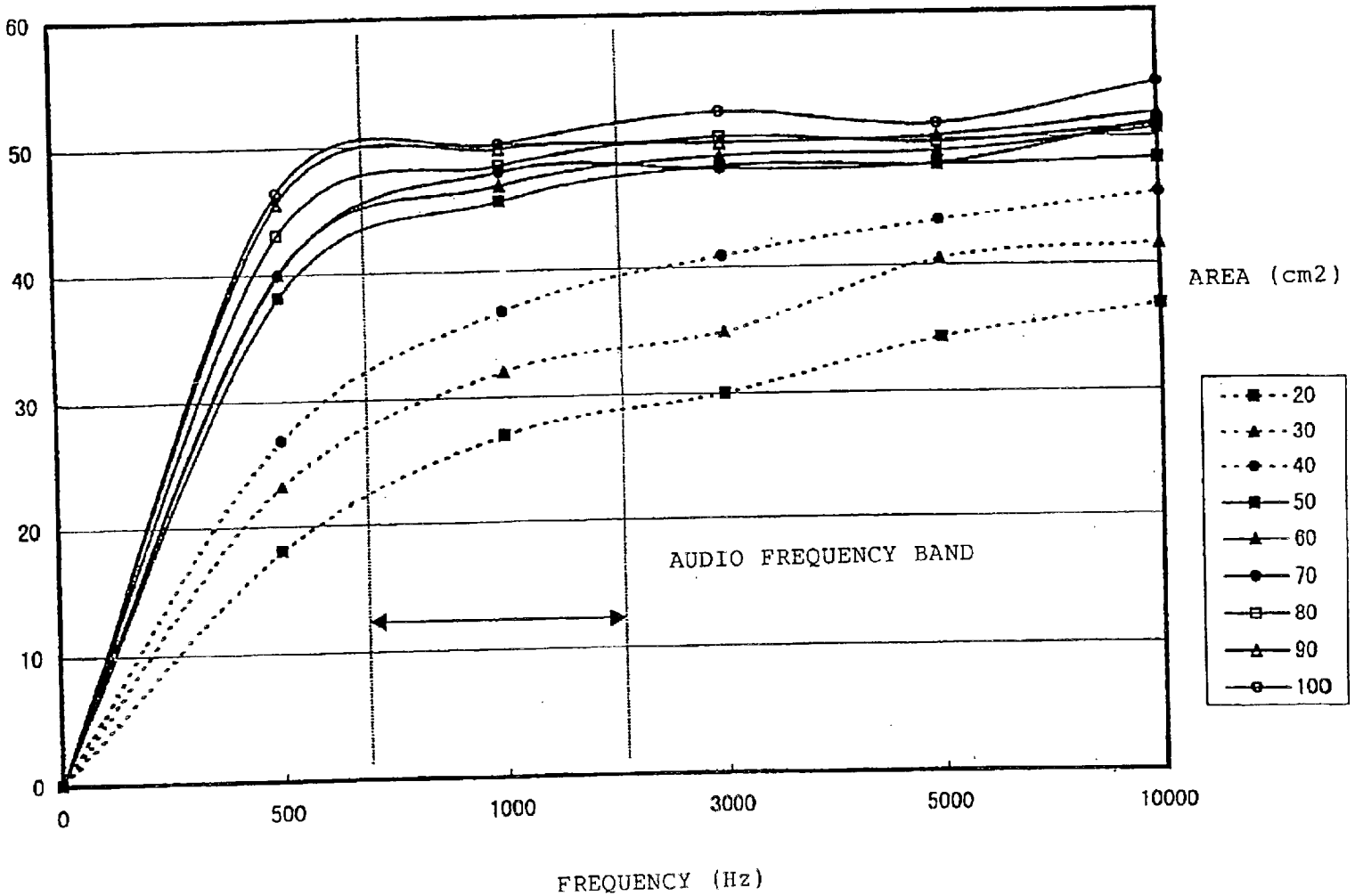
FIG. 5 is a graphical view showing frequency-sound pressure characteristics of the piezo-film speaker supported in a helmet while being curved in a specific curved shape, with an area of a principal plane of the piezo-film speaker taken as a parameter.

FIG. 5 is a graphical view showing frequency-sound pressure characteristics of the piezo-film speaker supported in a helmet while being curved in a specific curved shape, with an area of a principal plane of the piezo-film speaker taken as a parameter. The graph shows a relationship between frequency (Hz) and sound pressure (dB) of the piezo-film speaker, with an area S of the piezo-film speaker taken as a parameter. The piezo-film speaker is formed into a square shape having a thickness of 28 $\mu$m, and a radius of curvature at a curved portion of the piezo-film speaker is 500 mm.

In FIG. 5, data obtained with the area set at 50 $cm^2$ or more is shown by a solid line, and data obtained with the area set at 40 $cm^2$ or less is shown by a broken line. As is apparent from the experimental results produced by the present inventors and shown in FIG. 5, in the case of the piezo-film speaker having the area S in the range of 40 $cm^2$ or less, since the frequency characteristic of the sound pressure in the audio frequency band is not flattened, and more specifically, the sound pressure is reduced as the frequency becomes lower, a high frequency portion of voice is emphasized and subsequently deteriorates the tone quality. Furthermore, since the sound pressure level is relatively low, the efficiency of output to input becomes low.

On the other hand, in the case of the piezo-film speaker having an area S in the range of more than 40 $cm^2$, particularly, 50 $cm^2$ or more, the frequency characteristic of the sound pressure is desirably flattened and a sufficient sound pressure is obtained.

Since the area of a speaker capable of being built in a helmet is about 100 $cm^2$ or less, the area of the piezo-film speaker for a helmet may be more than 40 $cm^2$, (preferably, 50 $cm^2$ or more) and 100 $cm^2$ or less, that is, the area S may be limited to a range of 40 $cm^2 \leqq S \leqq 100$ $cm^2$, or preferably 50 $cm^2 \leqq S \leqq 100$ $cm^2$. By use of the piezo-film speaker having the area in the above desired range, it is possible to realize voice reproduction at a high tone quality and a sufficient volume while maintaining simplicity of the mounting requirements of the piezo-film speaker in a helmet.

In order to visually check/validate the fee reception at an ETC (automatic fee reception system) or visually acquire information from a navigation system, a motorcycle rider is required to move his line of sight downwardly. According to the present invention, however, since a speaker with sufficient characteristics can be built in a helmet without increasing the weight of the helmet or sacrificing the driver's comfort when the helmet is put on the driver's head, the above-described various kinds of information can be audibly acquired.

In summary, the present invention exhibits the following effects and advantages over the prior art. Since a radius R of curvature of the piezo-film speaker curvedly supported in a helmet is set in a range of $R \geqq 200$ mm, the frequency characteristic of a sound pressure in a frequency band of voice can be flattened, and voice can be reproduced at a high tone quality.

Since the radius R of curvature of the piezo-film speaker curvedly supported in a helmet is further limited and is set in a range of 210 mm$\leqq R \leqq$360 mm, the frequency characteristic of a voice signal in a frequency band can be flattened, but the sound pressure level can be made relatively high, with the highly desirable result that voice/audio reproduction is at a high tone quality and with sufficient volume.

Since an area S of a principal surface of the piezo-film is set in a range of $S \geqq 40$ $cm^2$, the frequency characteristic of a sound pressure in a frequency band of voice can be flattened, but the sound pressure level is also made relatively high. This arrangement also produces the highly desirable result that voice/audio reproduction can be accomplished at a high tone quality and with sufficient volume.

Since the area S of a principal surface of the piezo-film is further limited and is set in a range of 40 $cm^2 \leqq S \leqq 100$ $cm^2$, it is possible to accomplish voice reproduction at a high tone quality and with sufficient volume, while maintaining simplicity in the mounting requirements of a piezo-film speaker in a helmet.

Since a thin piezo-film speaker according to the present invention can be used, in place of a voice coil speaker as traditionally utilized in the background art as a speaker for a helmet, it is possible to accomplish voice reproduction at a high tone quality and with sufficient volume, without substantially increasing the total weight of the helmet and sacrificing a driver's comfort.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A motorcycle helmet including a hard, thin helmet shell, said helmet comprising:

a head liner fixed on an inner surface of said helmet shell;

a head inner removably and dividedly mounted so as to cover the head liner;

ear inners and a chin inner removably and dividedly mounted with respective liners on the inner surface of said helmet shell; and a plurality of piezo-film speakers mounted directly to the inner surface of said helmet shell, wherein each of said piezo-film speakers includes a piezo-film curvedly supported to form at least one curved portion, said piezo-film having at least a radius (R) of curvature at each curved portion in a range of $R \geqq 200$ mm or an area (S) of a principal surface of said piezo-film is in a range of $S \geqq 40$ $cm^2$.

2. The motorcycle helmet according to claim 1, wherein said piezo-film has a radius (R) of curvature at each curved portion in a range of 210 mm$\leqq R \leqq$360 mm and an area S of a principal surface of said piezo-film in a range of 40 $cm^2 \leqq S \leqq 100$ $cm^2$.

3. The motorcycle helmet according to claim 1, wherein said piezo-film has a radius (R) of curvature at each curved portion in a range of 210 mm$\leqq R \leqq$360 mm.

4. The motorcycle helmet according to claim 1, wherein said piezo-film has an area S of a principal surface of said piezo-film in a range of 40 $cm^2 \leqq S \leqq 100$ $cm^2$.

5. The motorcycle helmet according to claim 2, wherein said piezo-film speaker has a film thickness (t) of 110 $\mu$m.

6. The motorcycle helmet according to claim 3, wherein said piezo-film speaker has a film thickness (t) of 28 $\mu$m.

7. The motorcycle helmet according to claim 1, wherein said radius (R) of curvature at each curved portion is in a range of $210 \leqq R \leqq 340$ mm and an area S of a principal surface of said piezo-film in a range of 50 $cm^2 \leqq S \leqq 100$ $cm^2$.

8. The motorcycle helmet according to claim 1, wherein the radius (R) of curvature at each curved portion is in the range of $R \geqq 200$ mm and the area (S) of the principal surface of said piezo-film is in the range of $S \geqq 40$ $cm^2$.

* * * * *